US006608442B1

(12) United States Patent
Morel

(10) Patent No.: US 6,608,442 B1
(45) Date of Patent: Aug. 19, 2003

(54) FLAT BULB

(75) Inventor: Michel Morel, Plappeville (FR)

(73) Assignee: Koninklijke Philips Electronics N.V., Eindhoven (NL)

( * ) Notice: Subject to any disclaimer, the term of this patent is extended or adjusted under 35 U.S.C. 154(b) by 179 days.

(21) Appl. No.: 09/716,912

(22) Filed: Nov. 20, 2000

(30) Foreign Application Priority Data

Nov. 23, 1999 (FR) ..... 99 14743

(51) Int. Cl.[7] ..... H01J 17/04; H01J 61/30

(52) U.S. Cl. ..... 313/634; 313/493; 313/569; 313/341; 313/113; 313/343

(58) Field of Search ..... 313/493, 634, 313/317, 315, 578, 573, 341, 331, 333, 316, 343, 271, 272, 273, 274, 344, 631, 608

(56) References Cited

U.S. PATENT DOCUMENTS 3,788,721 A 1/1974 Vause ..... 316/17
4,585,971 A * 4/1986 Clegg ..... 313/341
5,500,574 A * 3/1996 Popov et al. ..... 315/248
5,977,707 A 11/1999 Koenig ..... 313/578
6,114,809 A * 9/2000 Winsor ..... 315/50
6,127,780 A * 10/2000 Winsor ..... 315/56

FOREIGN PATENT DOCUMENTS

| | | | |
|---|---|---|---|
| DE | 4438870 A1 | 5/1996 | ..... H01K/1/10 |
| FR | 1270856 | 9/1960 | |
| FR | 2748810 | 11/1997 | |
| GB | 2248141 A | 3/1992 | ..... H01K/7/00 |
| WO | WO9843278 | 3/1998 | |
| WO | WO9945557 | 2/1999 | |

* cited by examiner

*Primary Examiner*—Robert H. Kim
*Assistant Examiner*—Elizabeth Gemmell
(74) *Attorney, Agent, or Firm*—Frank Keegan

(57) ABSTRACT

The invention relates to a bulb designed for emitting radiation through an emission surface ES of an envelope ENV which contains a radiation source ELM. According to the invention, the emission surface ES is substantially planar, while the radiation source defines a planar surface parallel to the emission surface. A bulb according to the invention is capable of emitting a homogeneous radiation towards a planar surface with a high radiation density.

7 Claims, 3 Drawing Sheets

FLAT BULB

BACKGROUND OF THE INVENTION

The invention relates to a bulb designed for emitting radiation through an emission surface of an envelope which contains a radiation source.

In most known bulbs, the envelope has the shape of a cylindrical body of revolution, while the radiation source is formed by a filament or a cylinder of small diameter arranged on the axis of revolution of the envelope. Such a bulb is known from French patent no. 1,270,856. The radiation emitted by a bulb of this type manifests itself in the form of cylindrical heat waves whose axis is that of the envelope. When such a bulb is used for heating an object which has a planar receiving surface, such as the bottom of a vessel or a sheet of paper, the heat distribution as received by said surface is inhomogeneous, the regions of the receiving surface closest to the axis of the envelope being submitted to a more intense heat than the regions of the receiving surface which are farther removed from said axis. Such inhomogeneity has adverse effects, because a nominal heating level of the regions of the receiving surface farthest removed from the axis of the envelope may cause an overheating of the regions closest to this axis, and may thus damage the item to be heated, while on the other hand a nominal heating of the regions of the receiving surface closest to the axis of the envelope will imply an insufficient heating of the regions farthest removed from the axis.

Furthermore, the surface power density of the radiation emitted by the known bulbs is comparatively low, which translates itself into a low power efficiency.

SUMMARY OF THE INVENTION

The invention has for its object to remedy the above disadvantages by proposing a bulb capable of emitting a homogenous radiation towards a planar surface with a high radiation density.

To achieve this in a bulb according to the invention, the emission surface is substantially plane, and the radiation source defines a planar surface substantially parallel to the emission surface.

The planar shape of the emission surface and of the radiation source enables the bulb according to the invention to generate a radiation which arises in the form of planar heat waves, allowing a homogeneous heating of a planar receiving surface, provided the latter is arranged parallel to the emission surface. Moreover, the surface power density of the radiation emitted by the bulb according to the invention, and accordingly the efficiency of the heating operations carried out by means of said bulb, will be a function directly of the ratio between the surface defined by the radiation source and the emission surface, and may be adjusted through the design of the radiation source.

In a special embodiment of the invention, the radiation source is formed by at least one filament of flat shape.

In another special embodiment of the invention, the radiation source is formed by a plurality of co-planar filaments.

In another special embodiment of the invention, the radiation source is formed by at least one convoluted filament.

In a preferred embodiment of the invention, the radiation source is formed by a reactive gas which is to be excited by means of electrodes.

In a variant of the invention, the envelope has a reflecting surface arranged opposite the emission surface.

The reflecting surface enables to increase the surface power density of the radiation emitted by the bulb, and thus to increase even more the efficiency of the heating operations carried out by means of said bulb.

In another variant of the invention, the envelope has a surface which is convex towards the exterior of the envelope situated opposite the emission surface.

Such a convex shape of the surface situated opposite the emission surface will make it easier to position the bulb in a cavity provided within a lamp designed to accommodate the bulb. Moreover, if the convex surface is covered with a reflecting layer, part of the radiation emitted by the bulb will be concentrated towards the center thereof, which will render the construction of the radiation source easier in certain embodiments.

The invention will be better understood from the following description which is given by way of example, to which the invention is not limited, with reference to annexed drawings, in which:

DESCRIPTION OF THE PREFERRED EMBODIMENTS OF THE INVENTION

Figure 1:
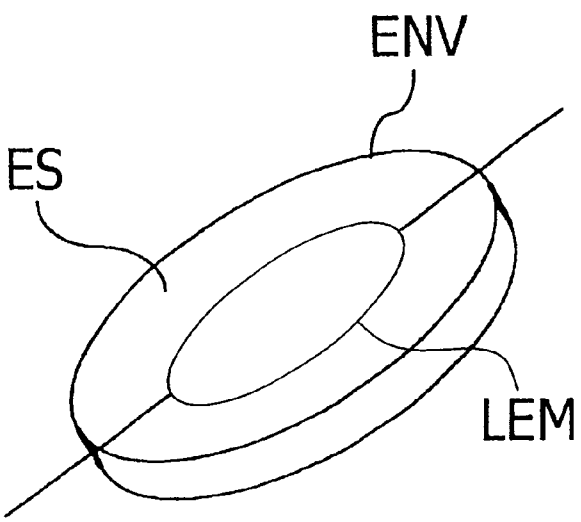
FIG. 1 is a perspective view of a bulb in an embodiment of the invention.

FIG. 1 diagrammatically shows a bulb representing a particular embodiment of the invention. This bulb is designed to emit radiation through an emission surface ES of an envelope ENV which contains a radiation source LEM. The envelope may advantageously be realized in quartz or a special glass which is transparent to infrared and/or visible light. Although the contour of the emission surface ES is circular in this example, it will be obvious that any other shape, oval, rectangular, square, polygonal, etc., may be chosen, depending on the application for which the bulb is designed.

The emission surface ES is planar, and the radiation source LEM defines a planar surface which is parallel to the emission surface ES. In the example described here, the radiation source LEM is formed by a filament of flattened shape. To make the Figure more easily understandable, the contour of the surface defined by this flattened filament is rectangular in this example, so that it can be better distinguished from the other elements of the bulb. It will be understood, however, that the surface power density of the radiation emitted by the bulb will be the greater as the surface defined by the radiation source LEM becomes more similar to the emission surface ES. In the present case the contour of the emission surface ES is circular, so it will be more advantageous in practice to give the contour of the flattened filament a circular shape as well.

Figure 2:
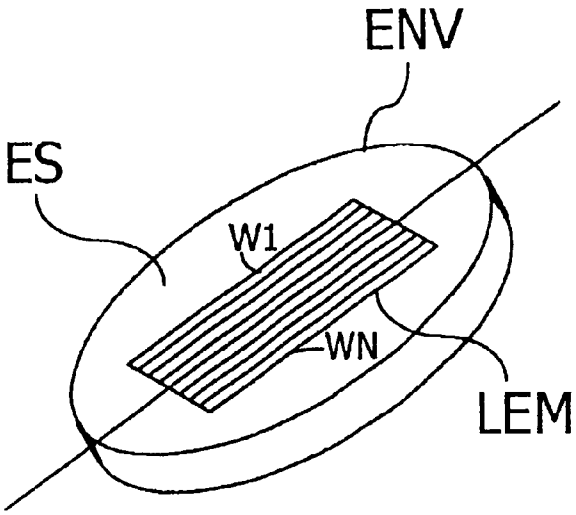
FIG. 2 is a perspective view of a bulb in another embodiment of the invention.

FIG. 2 shows another embodiment of the radiation source LEM which in this example is formed by N co-planar filaments W1, . . . , WN. These filaments form a grid whose contour is chosen to be rectangular in the example, so that it may be more easily distinguished from the other elements of the bulb. It will be understood, however, that it is more advantageous in practice, as explained above, to give the contour of this grid a circular shape so as to obtain a surface power density of the radiation emitted by the bulb which is an optimum for the case in which the emission surface is circular, as in the case shown here.

Figure 3:
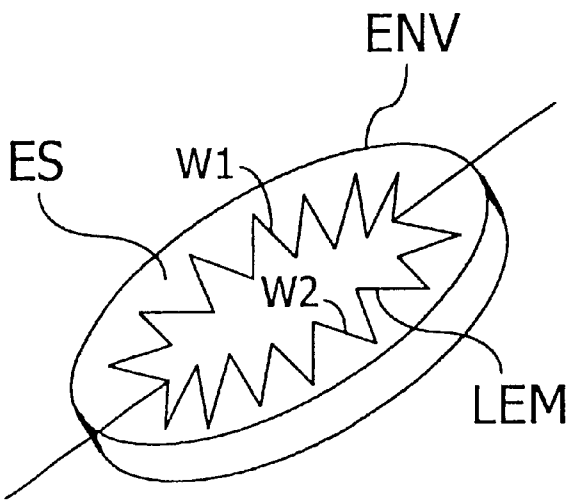
FIG. 3 is a perspective view of a bulb in another embodiment of the invention.

FIG. 3 shows another embodiment of the radiation source LEM which in this example is formed by two convoluted filaments W1 and W2. The convolutions of the filaments W1 and W2 are not very complicated here so that said filaments are still identifiable in the Figure. It will be understood, however, that it is necessary to create convolutions such that a major proportion of the points constituting the emission surface ES is perpendicular to a portion of one of the convoluted filaments so as to obtain an optimum surface power density. This principle may be departed from, however, if the surface lying opposite the emission surface ES is made convex towards the exterior of the envelope ENV and is covered with a reflecting layer, in which case a portion of the reflected radiation will be concentrated towards the center of the emission surface ES. This will enable to reduce the density of the convolutions of the filaments in the region of the center of the emission surface ES, and thus to simplify the construction of the radiation source EM easier without compromising the homogeneity of the radiation emitted by the bulb.

Figure 4:
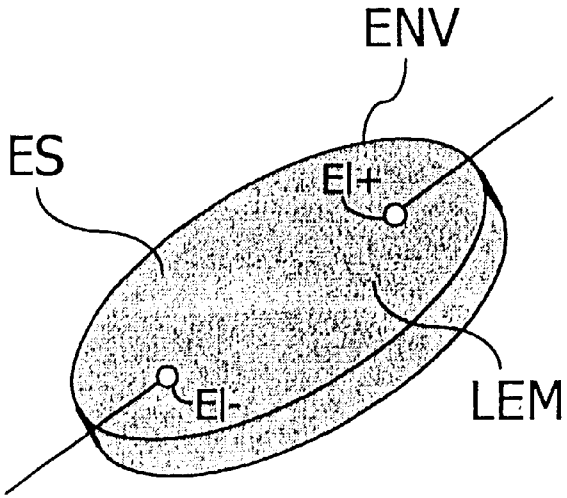
FIG. 4 is a perspective view of a bulb in a preferred embodiment of the invention.

FIG. 4 illustrates a preferred embodiment of the radiation source LEM which in this example is formed by a reactive gas, represented as a grey tone, which is to be excited by means of electrodes El+ and El−. The gas used may be, for example, xenon. This embodiment is particularly advantageous because the distribution of the gas is isotropic within the envelope ENV, so that the radiation emitted by the bulb is by its very nature homogeneous over the entire emission surface ES.

It is possible to cover the surface lying opposite the emission surface ES with a reflecting layer so as to improve the homogeneity and increase the power density of the radiation emitted by the bulb.

Figure 5:
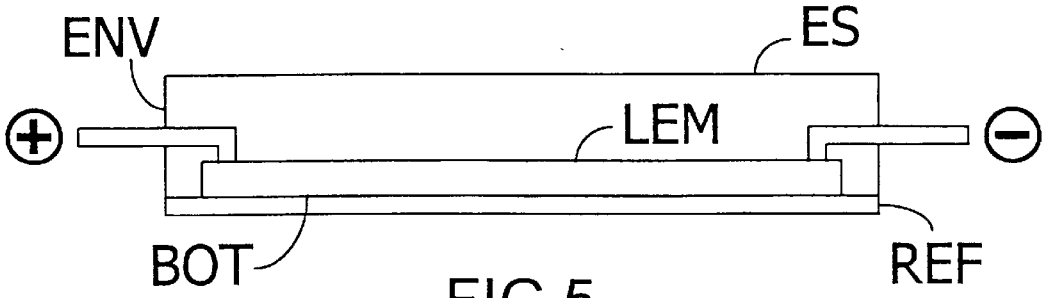
FIG. 5 is a cross-sectional view of a bulb in a variant of the invention.

FIG. 5 is a cross-sectional view of a bulb in a variant of the invention. In this bulb, the envelope ENV has a bottom BOT which lies opposite the emission surface ES. The radiation source LEM, for example a flattened filament or a plurality of co-planar elements realized in tungsten or some other radiation-emitting substance, is arranged on the bottom BOT. The thickness of this radiation source ELM has been exaggerated on purpose so that it is clearly visible in the Figure. If the radiation source ELM is formed by a material which is to be brought into the incandescent state, as is the case here, the envelope ENV will advantageously be filled with an inert gas before being sealed. A layer of reflecting material REF, for example based on a ceramic material, is deposited on the surface of the bottom BOT, on the outside of the envelope ENV, so as to enhance the power density of the radiation emitted by the bulb.

Figure 6:
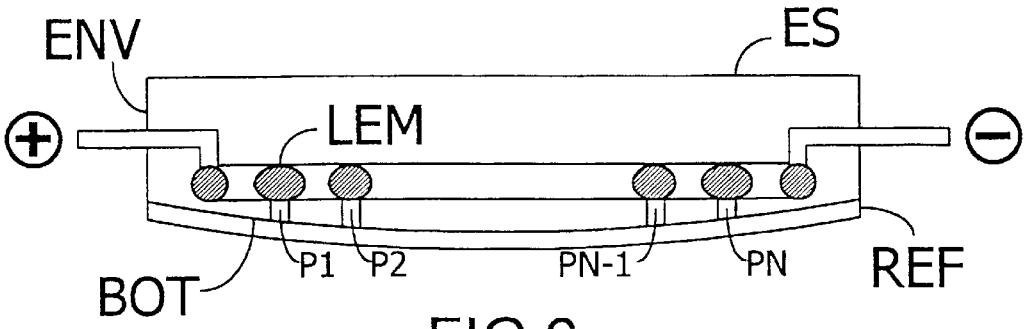
FIG. 6 is a cross-sectional view of a bulb in another variant of the invention.

FIG. 6 is a cross-sectional view of a bulb in another variant of the invention. In this bulb, the bottom BOT is convex towards the exterior of the bulb. The radiation source LEM in this example is formed by a plurality of convoluted filaments whose hatched cross-sections are visible in the cross-sectional plane. Some of these sections do not have a circular contour because, as may be deduced from FIG. 3, certain portions of the filaments may not be perpendicular to the cross-sectional plane. The radiation source LEM rests on the bottom BOT with a plurality of supports P1, . . . , PN interposed, which supports may also be made of tungsten, or of any other radiating material. A layer of reflecting material REF, for example based on a ceramic material, is deposited on the surface of the bottom BOT outside the envelope ENV so as to enhance the power density of the radiation emitted by the bulb and to concentrate this density towards the center of the bulb. This renders it possible to reduce the surface density of the convolution of the filaments in the center region of the emission surface ES without detracting from the homogeneity of the radiation emitted through said surface.

What is claimed is:

1. A bulb for emitting radiation through an emission surface of an envelope, wherein the emission surface is substantially planar and of a given shape and the envelope contains a radiation emitter which is at least one filament of flat configuration having an unperforated planar surface which is substantially parallel to the emission surface for emitting radiation therethrough, and wherein the planar surface of the filament is of the same shape as the emission surface.

2. A bulb as claimed in claim 1 wherein the bulb has a reflecting surface arranged opposite the emission surface.

3. A bulb as claimed in claim 1, wherein the envelope has a surface which is convex towards the exterior of the envelope situated opposite the emission surface.

4. A bulb as claimed in claim 1 wherein said at least one filament comprises a single filament.

5. A bulb as claimed in claim 1 wherein said at least one filament comprises a plurality of co-planar filaments.

6. A bulb for emitting radiation through an emission surface of an envelope wherein the emission surface is substantially planar and of a given shape and the envelope contains a radiation emitter which is a single filament of flat configuration having an unperforated planar emitting surface which is substantially parallel to the emission surface for emitting radiation therethrough, and wherein the planar surface of the single filament is of the same shape as the emission surface.

7. A bulb for emitting radiation through an emission surface of an envelope, wherein the emission surface is substantially planar and the envelope contains a radiation emitter which is at least one convoluted filament of flat configuration having a planar surface which is substantially parallel to the emission surface, wherein the envelope has a reflecting surface which is convex towards the exterior of the envelope situated opposite the emission surface.

* * * * *